US008302558B2

(12) United States Patent
Ripamonti et al.

(10) Patent No.: US 8,302,558 B2
(45) Date of Patent: Nov. 6, 2012

(54) APPARATUS FOR COATING A CYLINDER, IN PARTICULAR A WIPING CYLINDER OF AN INTAGLIO PRINTING PRESS

(75) Inventors: Maurizio Ripamonti, Segrate (IT); Didier Dupertuis, Goumoens-la-Ville (CH); Andrea Ganini, Mulazzano (IT); Daniel Baertschi, Les-Monts-de-Pully (CH)

(73) Assignee: KBA-NotaSys SA, Lausanne (CH)

( * ) Notice: Subject to any disclaimer, the term of this patent is extended or adjusted under 35 U.S.C. 154(b) by 1178 days.

(21) Appl. No.: 12/066,319

(22) PCT Filed: Sep. 12, 2006

(86) PCT No.: PCT/IB2006/053231

§ 371 (c)(1), (2), (4) Date: May 14, 2008

(87) PCT Pub. No.: WO2007/034362

PCT Pub. Date: Mar. 29, 2007

(65) Prior Publication Data

US 2008/0268168 A1 Oct. 30, 2008

(30) Foreign Application Priority Data

Sep. 21, 2005 (EP) ..... 05108740

(51) Int. Cl.
*B05C 11/00* (2006.01)

(52) U.S. Cl. ..... 118/666; 118/667; 427/8; 427/372.2

(58) Field of Classification Search ..... 427/8, 372.2; 118/666, 667

See application file for complete search history.

(56) References Cited

U.S. PATENT DOCUMENTS 3,767,457 A 10/1973 Hubbard et al.

(Continued)

FOREIGN PATENT DOCUMENTS

EP 1 504 898 2/2005

(Continued)

OTHER PUBLICATIONS

International Search Report for PCT/IB2006/053231 dated Mar. 30, 2007.

(Continued)

*Primary Examiner* — Robert S Walters, Jr.

(74) *Attorney, Agent, or Firm* — Nixon & Vanderhye P.C.

(57) ABSTRACT

There is described an apparatus (1) for coating a cylinder (C), in particular a wiping cylinder of an intaglio printing press, with a plastic composition comprising inter alia heating means (6) for applying radiant heat to the cylinder throughout its length as the cylinder is rotated, the heating means including a plurality of discrete heating elements (60) distributed along the length of the cylinder and around at least part of the peripheral surface of the cylinder, the heating elements being arranged at least in separate columns (60*a* to 6O*h*) disposed parallel to one another along the length of the cylinder. The apparatus further comprises a temperature sensing system (9) for measuring the surface temperature of the cylinder along the length of the cylinder and a processing unit coupled to the temperature sensing system (9) for controlling operation of the heating elements (60) as a function of the measured surface temperature and a desired temperature setting ($t_c$). The temperature sensing system (9) is adapted to output a temperature measurement profile ($T_m$) representative of the surface temperature of the cylinder measured along the length of the cylinder, the temperature measurement profile being subdivided into a plurality of zones (Z1 to Z8) each associated to one corresponding column of heating elements (60*a* to 6O*h*). Operation of each column of heating elements (60*a* to 6O*h*) is controlled by the processing unit on the basis of the surface temperature measured within at least one of the zones (Z1 to Z8).

16 Claims, 8 Drawing Sheets

U.S. PATENT DOCUMENTS

| | | | | |
|---|---|---|---|---|
| 3,785,286 | A | | 1/1974 | Giori |
| 3,900,595 | A | | 8/1975 | Giori |
| 4,054,685 | A | | 10/1977 | Giori |
| 4,339,472 | A | | 7/1982 | Tachibana et al. |
| 4,702,946 | A | | 10/1987 | Howland |
| 5,010,659 | A | | 4/1991 | Treleven |
| 5,180,612 | A | | 1/1993 | Rendell |
| 5,826,980 | A | * | 10/1998 | Kouzu et al. ..... 374/124 |
| 6,877,247 | B1 | | 4/2005 | DeMoore |

FOREIGN PATENT DOCUMENTS

| | | |
|---|---|---|
| GB | 1 116 972 | 6/1968 |

OTHER PUBLICATIONS

Office Action mailed Jul. 21, 2010 in U.S. Appl. No. 12/066,112.
International Search Report for PCT/IB2006/053201 mailed May 21, 2007.
Written Opinion for PCT/IB2006/053201 mailed May 21, 2007.
International Search Report for PCT/IB2006/053198 dated May 21, 2007.
Written Opinion of the International Searching Authority dated May 21, 2007.

* cited by examiner

APPARATUS FOR COATING A CYLINDER, IN PARTICULAR A WIPING CYLINDER OF AN INTAGLIO PRINTING PRESS

This application is the U.S. national phase of International Application No. PCT/IB2006/053231 filed 12 Sep. 2006 which designated the U.S. and claims priority to European Application No. 05108740.1 filed 21 Sep. 2005, the entire contents of each of which are hereby incorporated by reference.

TECHNICAL FIELD

The present invention generally relates to an apparatus for coating a cylinder, (particularly but not exclusively a wiping cylinder of an intaglio printing press) with a plastic composition and to a method of using such an apparatus.

BACKGROUND OF THE INVENTION

In intaglio printing presses, it is commonly known to use a wiping cylinder contacting the plate cylinder carrying the intaglio printing plate or plates as a wiping device for wiping and cleaning the surface of the intaglio printing plate or plates. The purpose of such a wiping cylinder is to simultaneously press the ink deposited onto the printing plates into the engravings and clean the excess ink from the plenum of the printing plates, i.e. the unengraved area of the printing plates outside the engravings.

In order to achieve good printing quality, the wiping cylinder is commonly designed in such a way that its outer surface contacting the printing plates is both physically and chemically resistant, i.e. is adapted to sustain the high contact pressure and friction with the printing plates and can withstand the physical and chemical contact with the ink components and pigments, as well as with the cleaning solutions which are used to clean the surface of the wiping cylinder.

It has already been proposed to provide such a wiping cylinder with an outer layer of resilient synthetic composition, namely a heat-hardenable plastic composition such as PVC. U.S. Pat. Nos. 3,785,286, 3,900,595 and 4,054,685 for instance disclose methods for making such wiping cylinders as well as apparatuses for implementing the said methods. These publications are incorporated by reference in the present application, especially in respect to the material used for forming such cylinders and to the machines and methods used for building such wiping cylinders. Referring for instance to the coating apparatus described in U.S. Pat. No. 4,054,685, means are provided for mounting a cylinder to be coated for horizontal rotation about its axis of rotation. Coating is performed by rotating the cylinder past a coating unit consisting of a straight-edged scraper blade mechanism disposed at one side of the cylinder and which extends parallel to the cylinder axis, this blade mechanism being adapted to be moved towards and away from the cylinder. The blade mechanism consists of two blades mechanically coupled to each other, namely a lower blade and an upper blade which are jointly designed to ensure a proper supply of heat-hardenable plastic material to the surface of the cylinder to be coated and allow adjustment of the thickness of the material to be deposited. The blade mechanism is adapted to be moved towards and away from the cylinder while maintaining the straight edge of the lower blade (i.e. the edge which extends along the length of the cylinder) parallel to the axis of rotation of the cylinder. The plastic material is supplied to the blade mechanism on top of the upper blade which is disposed, during coating of the cylinder, in an inclined relationship with respect to the cylinder so as to form a reservoir between the upper side of the upper blade and the periphery of the cylinder to be coated. Means are provided for restraining flow of the plastic material sideways from the reservoir. The blade mechanism can be translated towards and away from the cylinder in order to maintain a desired uniform spacing (a couple of millimeters or less) between the straight edge of the lower blade and the periphery of the cylinder along the full length of the cylinder. The cylinder is rotated in a direction to cause its periphery to move downwardly past the blade mechanism to thereby apply to the periphery of the cylinder a thin uniform layer of plastic composition having a thickness determined by the spacing between the straight edge of the lower blade and the periphery of the cylinder. This layer of plastic material is heat-cured by applying radiant heat to the cylinder throughout its length as the cylinder is rotated so as to cause hardening of the deposited layer of plastic material and produce a hardened layer of the desired hardness. Several layers with different hardnesses and thicknesses are preferably formed in this way onto the cylinder surface.

According to the solutions described in U.S. Pat. No. 4,054,685, radiant heat is applied to the cylinder by heating elements (such as heating lamps or resistor elements) which extends along the length of the cylinder and around at least part of the periphery of the cylinder. The position of these heating elements can be adjusted manually with respect to the position of the cylinder in order to obtain a substantially uniform heat distribution over the whole length of the cylinder. Before the coating process, a pyrometer is used to control the temperature distribution along the cylinder, the pyrometer being displaced manually in front of the cylinder. Once the initial adjustment of the heating elements has been performed, the pyrometer remains stationary in a mid-position and functions as a sensor for the automatic heating control whereby temperature and time are controlled according to a predetermined program.

One disadvantage of the above solution resides in the fact that each heating element extends along the whole length of the cylinder and in that heating control cannot be performed in a very precise manner along the length of the cylinder, especially at the two ends of the cylinder where temperature can fluctuate by a substantial amount due to edge effects caused by the rotation of the cylinder and the flow of air around the cylinder. Further, heating control is performed based on a local measurement of the surface temperature of the cylinder, i.e. at a mid-position, which does not precisely reflect the temperature profile along the whole length of the cylinder.

U.S. Pat. No. 5,180,612 discloses another coating apparatus which is fitted with a plurality of discrete heating elements (such as ceramic tiles) arranged in a matrix of five or six rows of eight elements, each row extending along the length of the cylinder. Each tile is curved to present a concave surface which is directed towards and somewhat follows the curvature of the cylinder. The tiles are mounted at their rear end onto a stainless steel reflector mounted inside a hood part that can be pivoted onto or away from the cylinder mounting location.

Electrical power to each tile can be independently switched by a matrix panel of push buttons with internal illumination capability such that those tiles which are switched on at any instant are indicated by the illumination of the corresponding push button. The heating profile is thus displayed by the illumination states of the push-buttons on the matrix panel. Further, the amount of electrical power fed to the various tiles is controlled in dependence upon the outputs of three non-contact IR temperature sensors which monitor the temperature of the surface of the cylinder. More precisely, left-hand side and right-hand side outer sensors monitor all three, two or the outermost one of the outer circumferential columns of tiles at the left-hand and at the right-hand ends of the matrix, respectively. These columns of the matrix are thus independently controlled or isolated by the outer located sensors. The remaining one of the eight columns of tiles, in the middle of the matrix, that is the fourth and fifth columns, or the third to sixth columns, or the second to seventh columns, are capable of being electrically controlled by a centrally positioned sensor.

A disadvantage of this solution resides in the fact that heating control cannot again be performed in a very precise manner along the length of the cylinder. While the provision of three separate sensors helps in achieving a more uniform control of the heating profile, the proposed control scheme is still insufficient. Indeed, at least one sensor (either the central sensor or each one of the outer sensors) controls a plurality of columns of heating elements, a common temperature measurement being apparently used to adjust the heating power of all the columns of heating elements associated to that sensor. This again is not a satisfying solution because heating control is based on a local measurement of the surface temperature of the cylinder which does not precisely reflect the temperature profile along the portion of the length of the cylinder that is subjected to the heating produced by the corresponding group of columns of heating elements.

Another disadvantage of this solution resides in the fact that the proposed configuration imposes constraints as to the location of the cylinder with respect to the heating elements and the sensors. Indeed, as three sensors are used to monitor the surface temperature of the cylinder at the left-hand side, the middle part and the right-hand side, respectively, the cylinder to be coated must be located so that its mid-point faces more or less precisely the centrally-located sensor and so that the outer sensors are still capable of reading the surface temperature of the outer zones of the cylinder. In addition, depending on the length of the cylinder to be processed, one has to ensure that the outer columns of heating tiles which emit IR radiations do not interfere with the outer sensors. This implies either the complete switching-off of outer columns of heating elements and/or locating the outer sensors in such a manner that they do not directly face the heating tiles that are not or partly hidden behind the cylinder.

SUMMARY OF THE INVENTION

An aim of the invention is to improve the known devices and methods

More precisely, it is an aim of the present invention to provide an apparatus for coating a cylinder with a plastic composition of the type comprising a heating device including discrete heating elements arranged at least in separate columns disposed parallel to one another along the length of the cylinder, which is of simpler construction that the known apparatuses.

Another aim of the present invention is to provide a coating apparatus which allows a better control and adjustment of the heating profile of the cylinder along its whole length.

Still another aim of the present invention is to provide a coating apparatus which exhibits greater flexibility and adaptability with respect to varying cylinder sizes and does not impose major constraints as regards the particular location of the cylinder with respect to the heating elements and/or the temperature sensing system.

Yet another aim of the present invention is to provide a coating apparatus allowing the manufacture of cylinders exhibiting an increased coating quality.

A further aim of the present invention is to provide a method for applying controlling the heating of a cylinder being coated.

These aims are achieved thanks to the apparatus and method defined in the claims.

According to the invention, the temperature sensing system used to measure the surface temperature of the cylinder is adapted to output a temperature measurement profile representative of the surface temperature of the cylinder measured along the length of the cylinder, the temperature measurement profile being subdivided into a plurality of zones each associated to one corresponding column of heating elements. The processing unit is adapted to control operation of each column of heating elements on the basis of the surface temperature measured within at least one of said zones. Thanks to this heating control scheme, each column of heating elements is controlled on the basis of a temperature measurement derived from the portion of the cylinder surface that is subjected that that column of heating elements. In contrast to the previous solutions, each column of heating elements can thus be controlled in direct dependence of the surface temperature of the corresponding portion of the cylinder surface and not in dependence of a temperature measurement taken at another location. Further, the subdivision into zones enables a selective adjustment of the heating profile along the length of the cylinder.

Advantageous embodiments of the invention are the subject-matter of the dependent claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

EMBODIMENTS OF THE INVENTION

Figure 1:
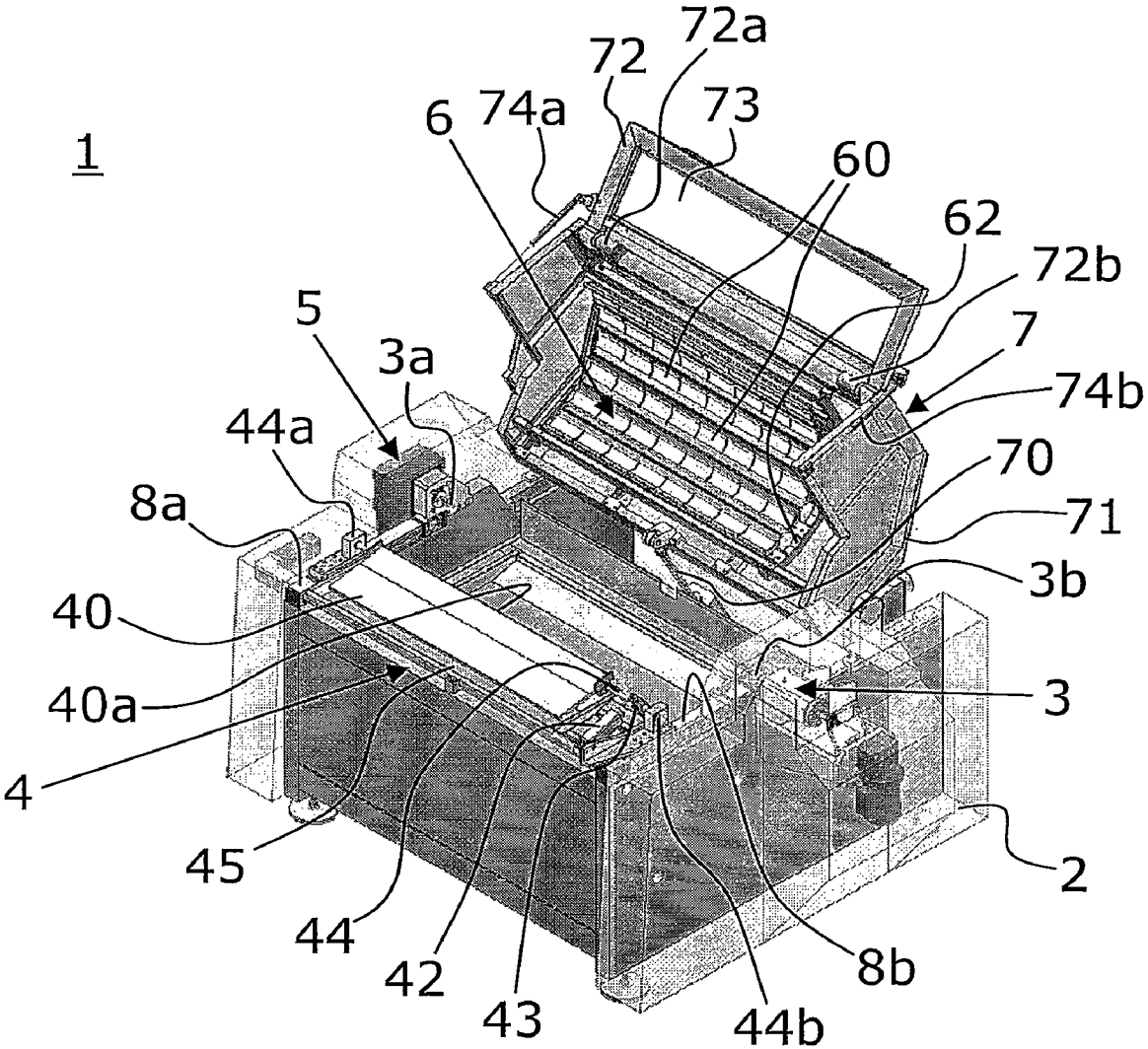
FIG. 1 is a perspective view of an embodiment of the coating apparatus showing a hood part of the apparatus in an open state.

FIG. 1 shows a perspective view of an embodiment of a coating apparatus according to the invention, designated globally by reference numeral 1. The coating apparatus 1 comprises a main machine body 2 which supports means 3 for horizontally mounting a cylinder to be coated (cylinder not shown in this Figure) for rotation about its axis of rotation, a coating unit 4 comprising, in this illustrative example, a blade mechanism with a single blade 40 disposed on one side of the cylinder for the application of the heat-hardenable plastic composition (the blade mechanism is shown in FIG. 1 in a rest position which is pulled back away from the cylinder mounting location), driving means 5 (e.g. an electric motor or the like) for rotating the cylinder in a direction to cause its periphery to move past the coating unit 4, and heating means 6 for applying radiant heat to the cylinder throughout its length as the cylinder is rotated to cause hardening of the deposited layer of plastic composition.

Not shown in the drawings is a central processing unit equipped with a user interface, known per se in the art, that is coupled to the functional parts of the machine and enables the operator to operate and interact with the machine. This central processing unit preferably includes a computer unit hosting the software need to run and control the coating apparatus, which computer unit is coupled to a graphic user interface advantageously taking the form of a touch screen mounted on a pivotable supporting arm coupled at the frontal side of the machine body 2 (preferably on the right-hand corner of the frontal side of the machine 2) so that the operator can adjust and monitor the various parameters of the machine while facing the cylinder from the frontal part of the machine. The computer unit may be installed in the machine body 2 or in a separate electronic cabinet disposed proximate to the coating apparatus 1. Within the scope of the present invention, the central processing unit in particular performs control of the operation of the heating means 6 as a function of a temperature measurement of the surface of the cylinder as this will be explained hereinafter in detail.

In this preferred embodiment, the heating means 6 are located in a movable hood part 7 which can be pivoted onto or away from the cylinder location by an actuation mechanism 70 (such as a pneumatically-actuated arm coupled at one extremity to the main machine body 2 and at the other extremity to the hood part 7). The hood part 7 is advantageously provided with a hood body 71 and a window panel 72 comprising a window frame carrying a transparent heat-resistant glass window 73. In this example, the window panel 72 is preferably mounted rotatably at its upper part onto the hood body 71 by a pair of hinge members 72*a*, 72*b*, the window panel 72 being shown in an open position in FIG. 1. This window panel 72 enables the operator to have a clear view of the cylinder surface during both coating and heating of the cylinder when the hood part 7 is in its closed position (even when the panel 72 is closed onto the hood part 7). In the preferred embodiment as shown, the window panel 72 is further coupled to the hood body 71 by a pair of piston-like supporting members 74*a*, 74*b* enabling the window panel 72 to remain in any of a plurality of open positions.

The heating means 6 include a plurality of individual heating elements 60 (preferably ceramic heating elements shaped like curved tiles) mounted on a curved supporting frame 62 located inside the hood part 7. In this illustrative example, the heating elements 60 are arranged so as to form an array of eight columns of six heating elements each that are mounted on the curved supporting frame 62 so as to follow the curvature of the cylinder to be coated and extend along the full length of the cylinder.

Aspiration means, not shown in detail in the Figures, are further provided in the hood part 7 so as to suitably aspirate the fumes that are generated during the coating and heating processes. These fumes are preferably evacuated to an external condensation and/or filter unit (not shown) before disposal.

The means 3 for horizontally mounting the cylinder to be coated for rotation about its axis of rotation include a pair of bearings 3*a*, 3*b* that resemble the head-stock and tail-stock, respectively, of a lathe. The head-stock 3*a* holds a revolving spindle driven by the driving means 5 for coupling with one extremity of the cylinder to be coated and for driving the cylinder into rotation. The tail-stock 3*b* can be moved axially along the axis of rotation of the cylinder to be coated to be secured to the other extremity of the cylinder and to accommodate different lengths of cylinder. If necessary, shaft extensions can be secured to one or both of the head-stock 3*a* and tail-stock 3*b* in order to mount short cylinders.

As mentioned hereinabove, the coating unit 4 is shown in FIG. 1 in a rest position (or cleaning position). The blade 40 is mounted on the coating unit 4 so as to be able to rotate about a rotation axis which is substantially parallel to the axis of rotation of the cylinder to be coated. More precisely, in the rest position, the blade 40 is rotated in such a manner that waste material from the coating process can be cleaned away from the blade into a collecting receptacle 45 disposed underneath the blade 40 (in this example the blade 40 is rotated in such a way that its upper side is oriented towards an operator which would face the frontal part of the machine). This collecting receptacle 45 is advantageously secured to the coating unit 4 so as to follow its movement toward and away from the cylinder to be coated. The collecting receptacle could alternatively be fixedly secured to the machine body 2.

The coating unit 4 is adapted to be moved towards and away from the cylinder to be coated. To this end, the coating unit 4 is coupled to translation means comprising a pair of guide members 8*a*, 8*b* located on each side of the coating unit 4. Translation of the coating unit 4 onto the guide members 8*a*, 8*b* is induced by suitable driving means, preferably electrical motors. The translation means ensure appropriate displacement of the coating unit 4 between the cleaning position, shown in FIG. 1, and the operating position (or coating position), shown in FIG. 2, as well as micrometric retraction of the coating unit 4 away from the surface of the cylinder during the coating operation.

Figure 2:
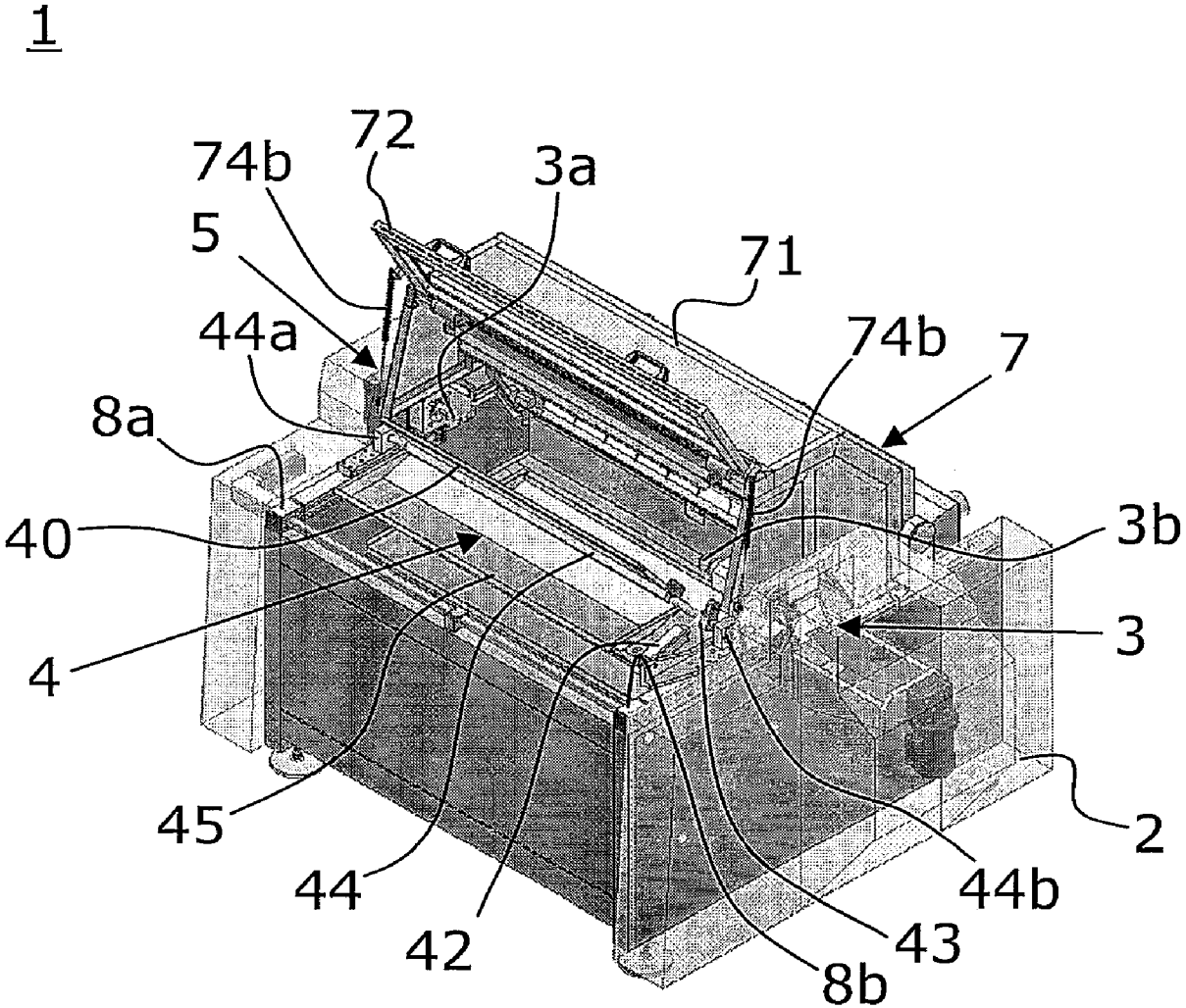
FIG. 2 is a perspective view of the coating apparatus of FIG. 1 showing the hood part of the apparatus in a closed state.

FIG. 2 is a perspective view of the embodiment of FIG. 1 showing the hood part 7 in its closed position (the window panel 72 being still shown in an open state) and the coating unit 4 in its coating position. FIG. 2 also shows the tail-stock 3*b* moved axially towards the head-stock 3*a* as this would be the case after having mounted a cylinder to be coated between the head-stock 3*a* and tail-stock 3*b* (no cylinder being again shown in FIG. 2 for the sake of simplification).

FIG. 2 further shows that the blade 40 of the coating unit 4 is rotated towards the cylinder to be coated, the straight edge 40*a* of the blade 40 (see FIG. 1) being directed towards the periphery of the cylinder. More precisely, the blade 40 is disposed, during coating of the cylinder, in an inclined relationship with respect to the cylinder so as to form a reservoir between the upper side of the blade 40 and the periphery of the cylinder for receiving a supply of heat-hardenable plastic composition.

Rotation of the blade 40 between the cleaning position shown in FIG. 1 and the coating position shown in FIG. 2 is advantageously performed by means of an actuator 42 (such as a pneumatic piston) actuating a rotating arm 43 coupled to the underside of the blade 40 via a shaft member 44 (the shaft member 44 being mounted between two bearings 44*a*, 44*b* supported at each side of the coating unit 4 on the guide members 8*a*, 8*b*). The means 42, 43, 44 for causing rotation of the blade 40 form means for discontinuing the application of the plastic composition at the end of the coating process.

Figure 3A:
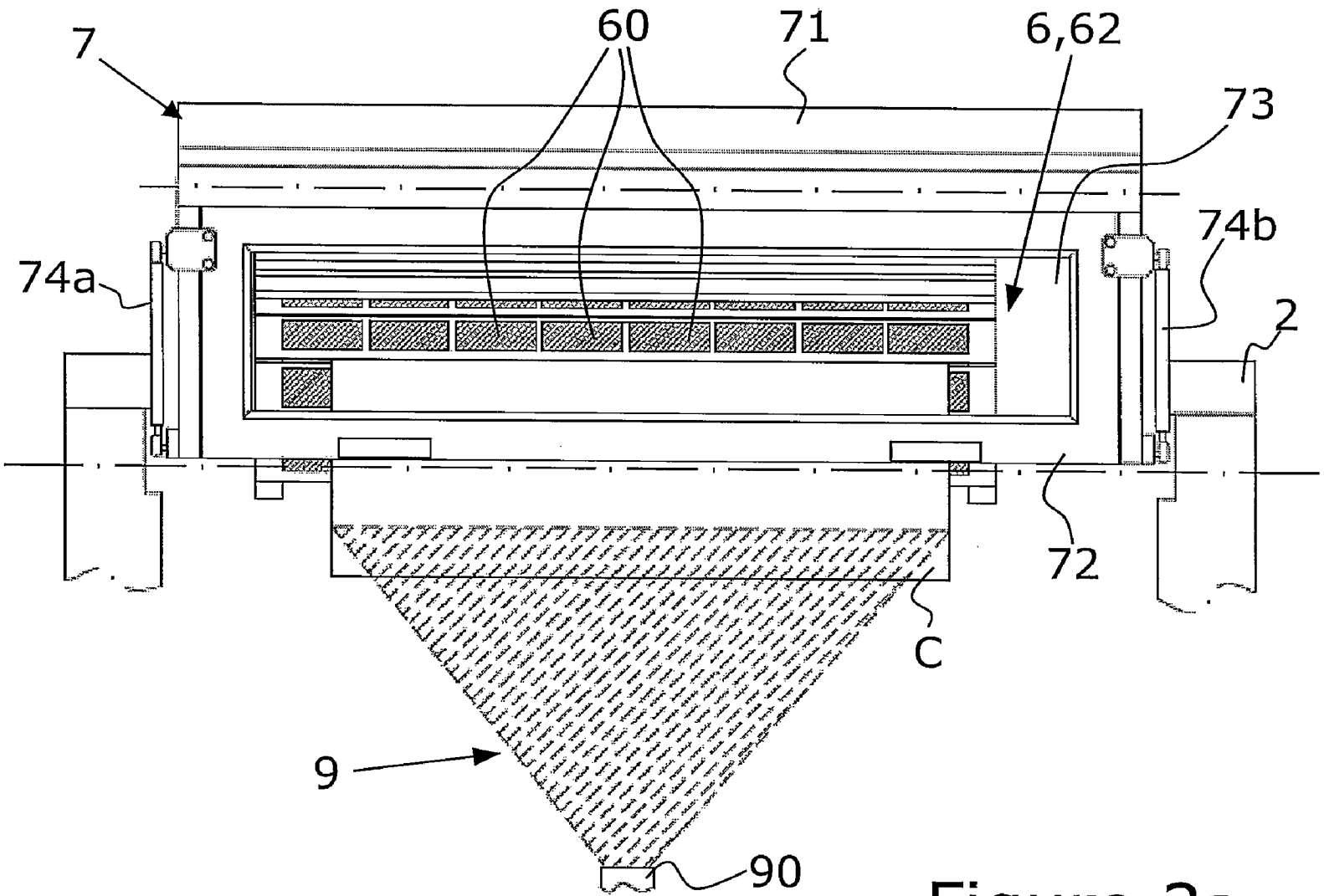
FIG. 3*a* is a schematic front view of the coating apparatus of FIGS. 1 and 2.
Figure 3B:
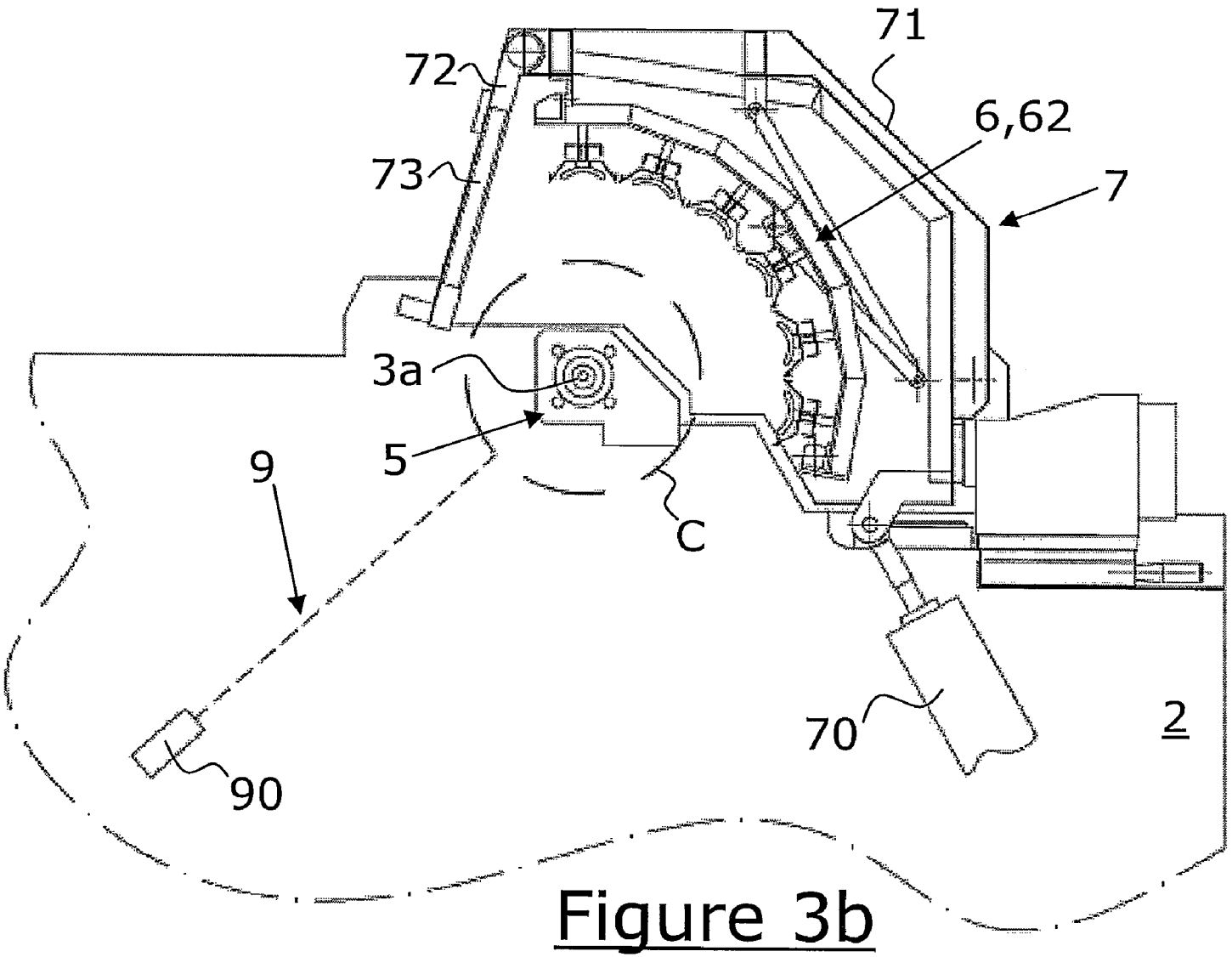
FIG. 3*b* is a schematic side view of the coating apparatus taken perpendicularly to the axis of rotation of the cylinder, from the right-hand side of the apparatus.

FIG. 3*a* is a schematic front view of the apparatus of FIGS. 1 and 2 taken approximately perpendicularly to the window panel 72 (in the closed position), while FIG. 3*b* is a side view of the coating apparatus 1 taken perpendicularly to the axis of rotation of the cylinder C (from the right-hand side of the machine) showing the hood part 7 in the closed state, pivoted onto the cylinder mounting location by the actuation mechanism 70. The elements already mentioned hereinabove in connection with FIGS. 1 and 2 are again designated by their corresponding reference numerals. The coating unit 4 is not shown in FIGS. 3*a* and 3*b*, but it will be understood that, during coating of the cylinder C, the coating unit 4 would be displaced forward as shown in FIG. 2 to be brought close to the peripheral surface of the cylinder C. During the coating operation, the coating unit 4 is retracted micrometrically away from the peripheral surface of the cylinder C, while maintaining a desired small spacing (a couple of millimeters or less) between the blade 40 of the coating unit and the surface of the cylinder C, this spacing defining the thickness of the layer of plastic material applied onto the surface of the cylinder. At the end of the coating process, the blade 40 is rotated to discontinue application of the plastic material and the coating unit 4 is pulled back to its cleaning position illustrated in FIG. 1.

Also shown in FIGS. 3*a* and 3*b* is the temperature sensing system, designated globally by reference numeral 9, used for measuring the surface temperature of the cylinder C and outputting a temperature measurement profile (designated hereinafter by reference $T_M$) representative of the said surface temperature of the cylinder C measured along its length. Preferably, this temperature sensing system 9 includes a single contact-less sensor 90 fixedly secured to the machine body 2 and which is adapted to scan the whole length of the cylinder C. This sensor 90 is advantageously an infrared (IR) sensor which optically scans the surface of the cylinder C and measures the infrared emissivity of the surface of the cylinder in order to derive a temperature measurement of the said surface. According to this preferred embodiment, the sensor 90 is disposed approximately in a mid-position with respect to the heating means 6.

Preferably, the temperature sensing system 9 is adapted to output a temperature measurement profile $T_M$ comprising a plurality of measurement samples taken along the length of the cylinder C. The sample resolution (i.e. the number of samples per unit of distance), should be chosen with a view to generate a temperature measurement profile $T_M$ having a sufficient preciseness. For the sake of example, a sample resolution of the order of 0.2 to 0.3 samples per millimeter was found to be adequate for this application. With such a sampling resolution, the temperature measurement profile $T_M$ of a cylinder having a length of 900 mm would include between 180 and 270 successive samples.

Rather than a centrally-located sensor as illustrated in FIGS. 3*a* and 3*b*, one could alternatively use a line sensor extending along a parallel to the axis of rotation of the cylinder C and adapted to take a snap-shot of a complete line on the surface of the cylinder C. A centrally-located scanning sensor is however preferred because of its smaller dimensions and usually lower cost.

Figure 4:
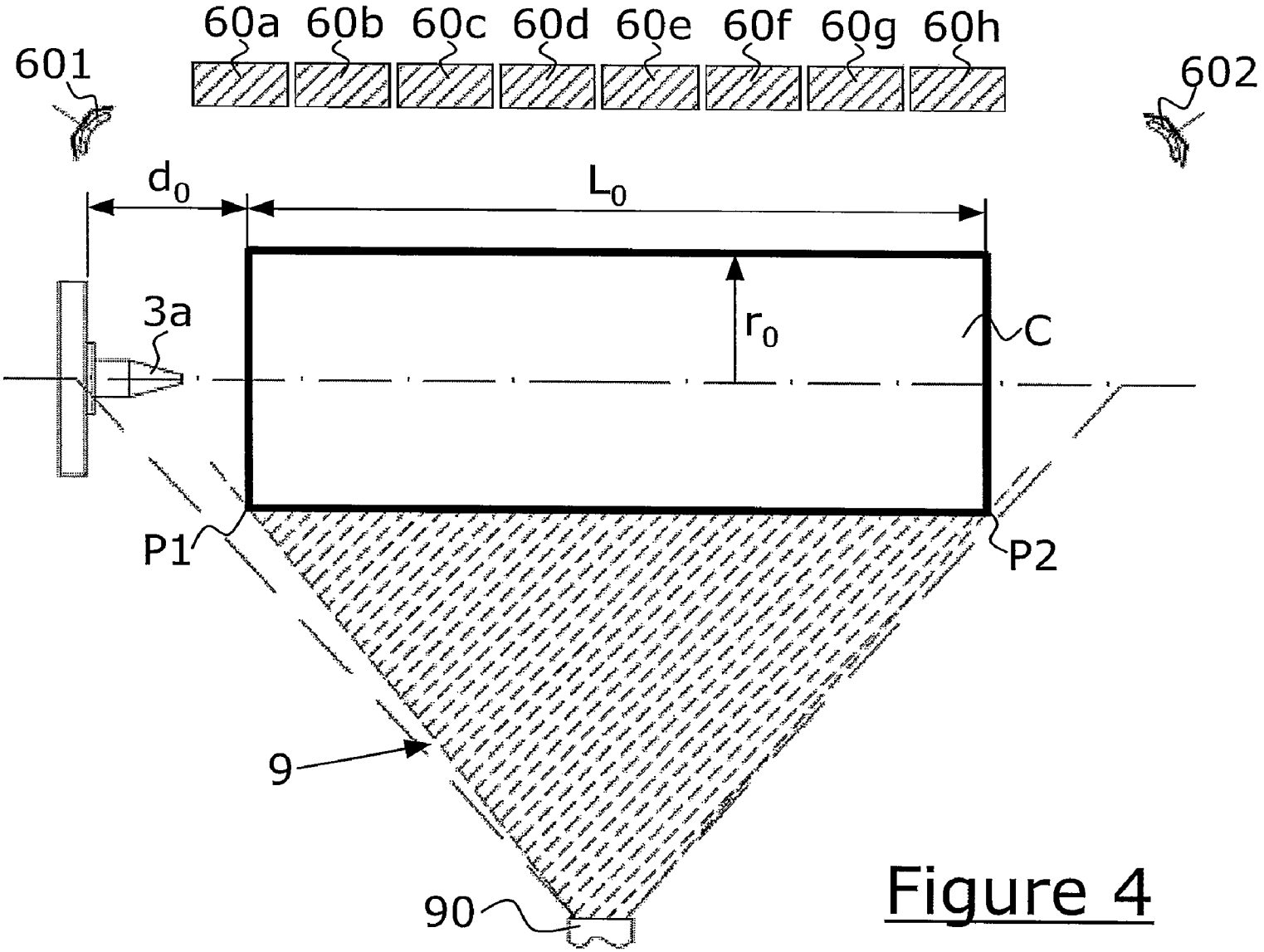
FIG. 4 is a schematic front view illustrating the disposition of the cylinder with respect to the supporting means, the heating means and the temperature sensing means of the coating apparatus.

FIG. 4 is a schematic view of the coating apparatus showing only the heating means 6, the temperature sensing system 9 with its sensor 90, the head-stock 3*a* of the supporting means 3 and the cylinder C. The shaft portions of the cylinder C are not illustrated in the drawing but it will be understood that such shaft portions will be coupled to the head-stock 3*a* and tail-stock 3*b* respectively. Each one of the eight columns of heating elements 60 is schematically illustrated on the upper part of FIG. 4 and designated by corresponding references 60*a* to 60*h* (from the left to right), columns 60*a* and 60*h* designating the two outer-located columns of heating elements 60. Also shown in FIG. 4, are two additional heating elements 601, 602 (or lateral heating elements) placed on the left-hand side and right hand side of the cylinder C. These two heating elements 601, 602, not illustrated in the previous Figures, might advantageously be disposed in the vertical side panels located on the left-hand side and right-hand side of the hood body 71. The purpose of these lateral heating elements 601, 602 is to apply heat to each extremity of the cylinder C. These two lateral heating elements 601, 602 can help maintaining a desired heating temperature at the two ends of the cylinder C where temperature may fluctuate due to air disturbances caused by the rotation of the cylinder.

In this context, it can also be advantageous to construct the heating means 6 in such a way that the heating power of at least the two outer-located columns 60*a* and 60*h* of heating elements 60 is greater than the centrally-located columns 60*b* to 60*g*, so as to compensate for temperature losses that can be encountered at the two ends of the cylinder C and avoid the use of the heating elements 601 and 602.

In FIG. 4, one can notice that the scanning area of the sensor 90 is wider than the effective measurement area enclosing the cylinder C (which measurement area is indicated by dashed-hatched lines in the Figure). The scanning area of the sensor 90 should be selected in such a way as to be able to scan a wide range of cylinder sizes (the cylinder C shown in FIG. 4 representing one of the larger cylinder sizes that can be processed in the coating apparatus). One will understand that, for smaller cylinder sizes, the effective measurement area enclosing the cylinder would be correspondingly smaller. As a matter of fact, the effective measurement portion of the temperature measurement profile $T_M$ will depend not only on the dimensions of the cylinder, but also on its mounting position within the apparatus, or more precisely the position between the head-stock 3*a* and tail-stock 3*b* of the supporting means 3. In the illustrative example, the effective measurement area is defined by a starting point P1 and end point P2 which can be determined on the basis of distance values $d_0$, $L_0$ and $r_0$ which are shown in FIG. 4. Distance values $L_0$ and $r_0$ are respectively the cylinder length and cylinder radius of cylinder C, while distance value $d_0$ is the cylinder offset, i.e. the distance between the extremity of the cylinder C secured to the head-stock 3*a* and a reference situated in this example of the left-hand side of the machine body 2. The three values $d_0$, $L_0$ and $r_0$ can advantageously be stored in a central processing unit (not shown) as settings parameters for each type of cylinder to be processed onto the coating apparatus. By selecting the appropriate settings parameters corresponding to the cylinder to be coated, the effective measurement area of the sensor 90 can thus be automatically adjusted without this requiring a particular setting manipulation from the operator.

It will be appreciated that the cylinder radius $r_0$ is considered as a setting parameter for adjusting the effective measurement area of the centrally-located sensor 90 of the preferred embodiment illustrated in the Figures. Consideration of this parameter might however not be necessary in the case of a sensing system using a line sensor extending parallel to the axis of rotation of the cylinder C as sensing would occur substantially perpendicularly to the axis of rotation of the cylinder C.

In summary, according to a preferred embodiment, the temperature sensing system 9 is adapted to scan an area greater than the area of the cylinder C and the processing unit is adapted to isolate an effective measurement portion of the temperature measurement profile $T_m$ corresponding to the cylinder C to be coated based on the dimensions ($L_0$, $r_0$) and position ($d_0$) of the cylinder C, control of the operation of the heating means 6 being based on this effective measurement portion of the temperature measurement profile $T_m$.

One will understand that an advantage of the scanning scheme explained hereinabove resides in the fact that the actual position of the cylinder C with respect to the heating means 6 and/or the sensing system 9 is of little importance as long as the whole length of the cylinder C can be heated by the heating means 6 and can be scanned by the sensing system 9. Hence, the cylinder C does not need to be disposed in a symmetrical manner with respect to the heating means 6 and/or sensing system 9. This in particular gives greater flexibility as regards the manner in which the cylinder C is to be mounted on the supporting means 3, 3*a*, 3*b*.

Figure 5:
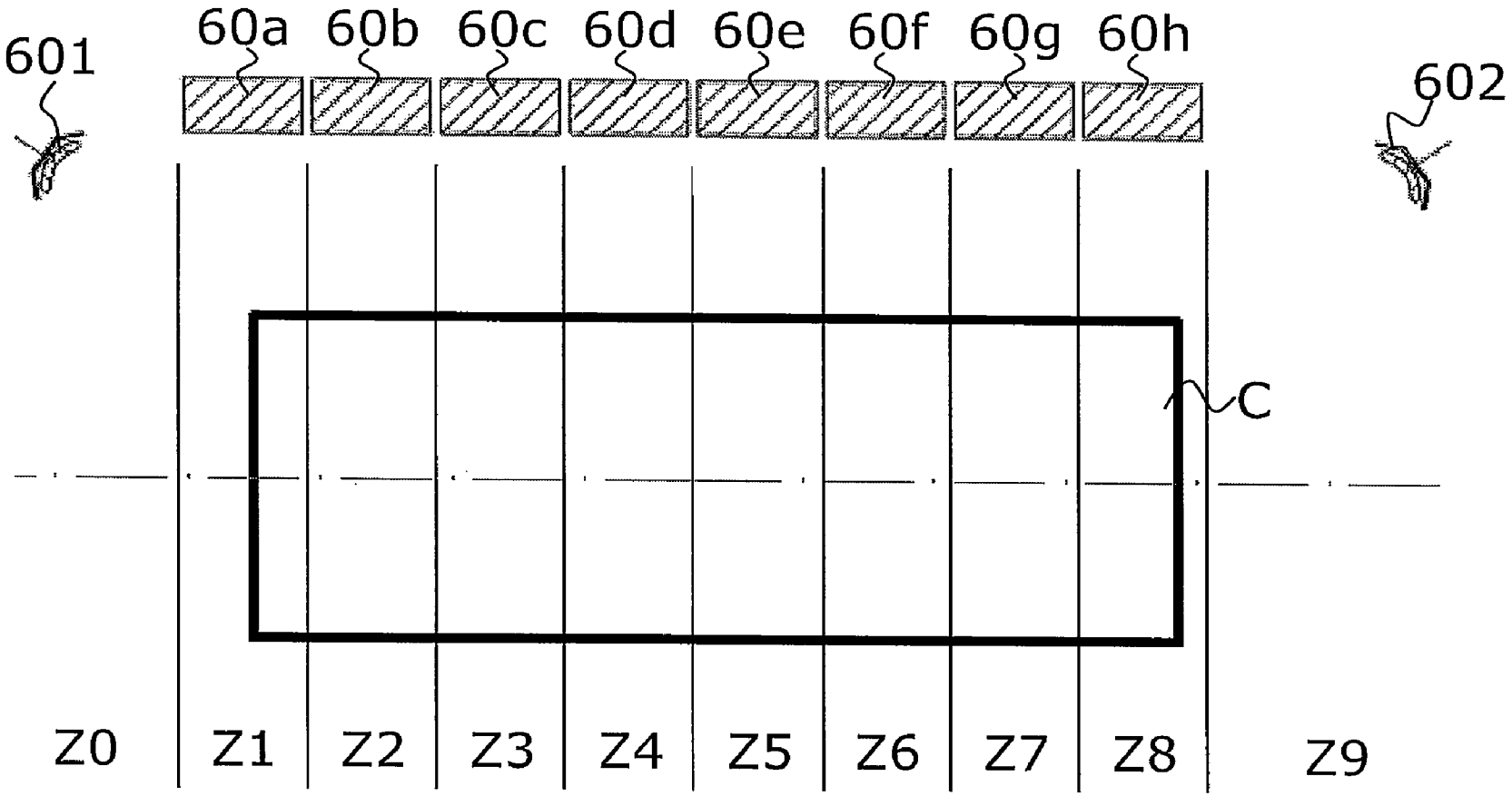
FIG. 5 is a schematic front view illustrating in greater details the heating means and associated zones on the basis of which heating control is performed.

FIG. 5 is a schematic view of the coating apparatus showing only the cylinder C and the heating means 6 with the eight columns of heating elements 60*a* to 60*h* and the two optional lateral heating elements 601, 602. According to the invention, a distinct zone is defined and associated to each column 60*a* to 60*h* of heating elements 60, as well as to the lateral heating elements 601 and 602. More precisely, a total of ten zones designated by references Z0 to Z9 is defined, zones Z0 and Z9 being respectively associated to lateral heating elements 601 and 602, while zones Z1 to Z8 respectively correspond to columns of heating elements 60*a* to 60*h*. The purpose of this zone subdivision will be explained with reference to FIG. 6.

Figure 6:
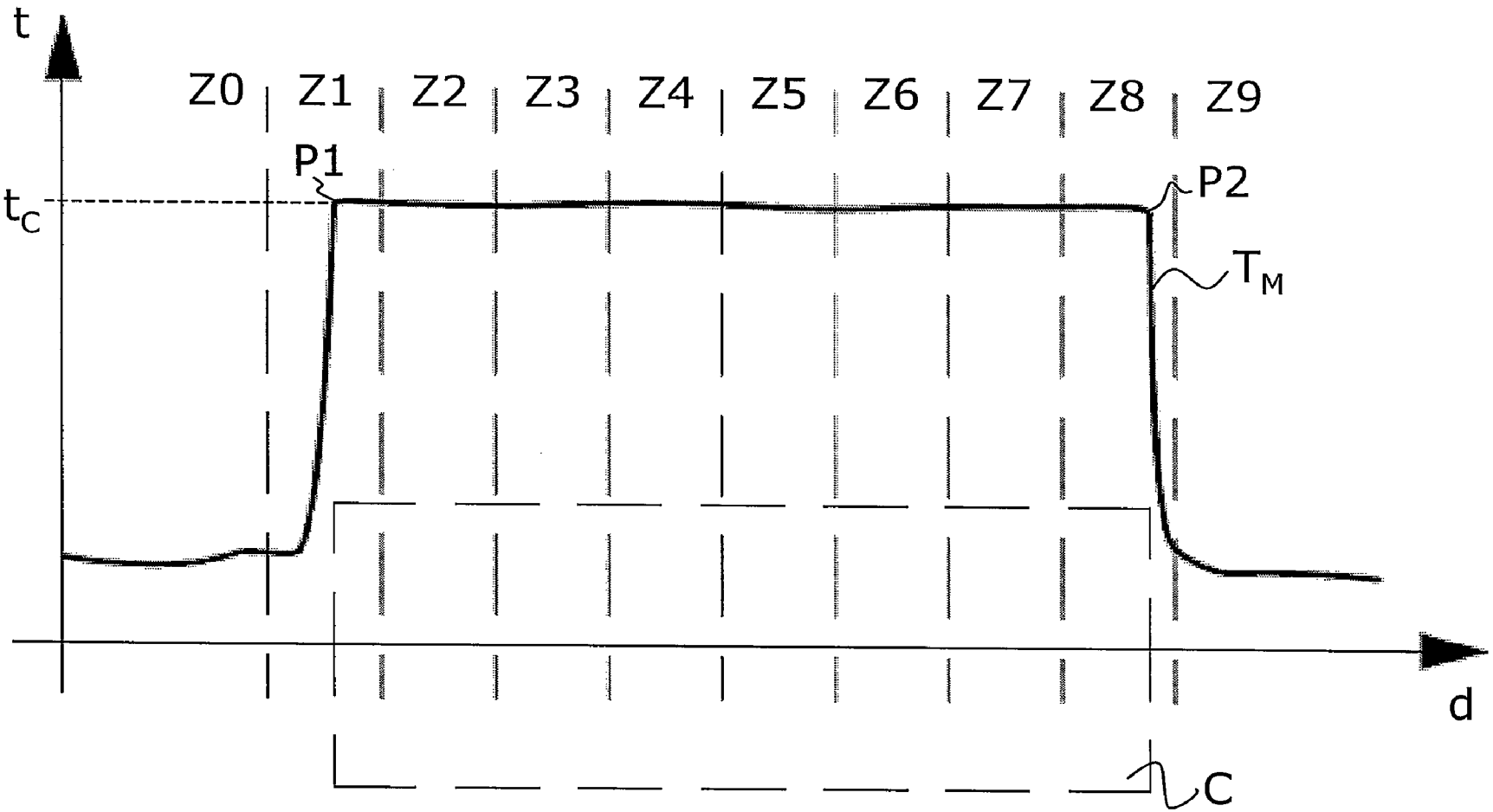
FIG. 6 is a schematic diagram of a temperature measurement profile measured along the length of the cylinder as it would be outputted by the temperature sensing system at a point in time during processing of the cylinder where the surface of the cylinder is heated to reach a determined temperature.

FIG. 6 is a schematic diagram illustrating a temperature measurement profile $T_M$ measured along the length of the cylinder C (which cylinder C is schematically represented in dashed lines in FIG. 6) as it would be outputted by the sensing system 9 at a moment in time during processing of the cylinder C where the surface of the cylinder is heated to reach a determined temperature $t_C$. In FIG. 6, the temperature measurement profile $T_M$ is represented for the whole scanning area of the sensor 90. One will however understand that only a portion of the temperature measurement profile $T_M$ is exploited for the purpose of heating control, namely the measurement portions between points P1 and P2 in FIG. 6 that correspond to the two extremities of the cylinder C being processed. The remaining part of the temperature measurement profile $T_M$ is not taken into account. In this particular example, the portion of the temperature measurement profile $T_M$ used for the purpose of heating control overlaps with zones Z1 to Z8 corresponding to the columns of heating elements 60*a* to 60*h* (as defined in FIG. 5), there being only a partial overlap with zones Z1 and Z8.

Operation of each column of heating elements 60*a* to 60*h* is controlled on the basis of the corresponding portion of the temperature measurement profile $T_M$ located within the associated zone Z1 to Z8, or more precisely on the basis of the series of measurement samples located within that zone. For each zone, a temperature measurement value is computed by the central processing unit on the basis of the measurement samples included in that zone and this value is used to adjust operation (i.e. the effective heating power output) of the associated column of heating elements. This temperature measurement value can advantageously be defined as the mean value or the maximum value among the corresponding series of measurement samples.

During heating of the cylinder C, operation of each column of heating elements 60*a* to 60*h* is adjusted on the basis of the temperature value derived for each corresponding zone Z1 to Z8. More precisely, once a desired surface temperature $t_C$ is reached the power output of each column of heating elements 60*a* to 60*h* is adjusted so as to maintain the surface temperature of the cylinder around the desired surface temperature $t_C$.

The lateral heating elements 601, 602 (zones Z0 and Z9) can be operated at a determined nominal value during the whole heating process (i.e. independently of the other heating elements). Preferably, operation of the lateral heating elements 601, 602 is coupled to one of the columns of heating elements 60*a* to 60*h* (i.e. in dependence of the other heating elements). In the illustrative example, operation of the lateral heating elements 601, 602 may for instance be coupled to zones Z1 and Z8 respectively. In this way, once the desired surface temperature is reached, operation of the lateral heating elements 601, 602 will follow that of columns of heating elements 60*a* and 60*h* respectively.

One will appreciate, that depending on the dimensions of the cylinder (especially for smaller-sized cylinders) there might be no overlap at all between one or more zones (for instance the outer-located zone Z1 and/or Z8) and the effective measurement portion of the temperature heating profile $T_M$ used for the purpose of heating control. In this case, the column of heating elements corresponding to that zone for which there is no overlap could simply be switched off. Preferably, rather than switching off this column, it is more advantageous to couple operation of the column of heating elements to the neighbouring one (for instance coupling operation of column 60*a* with that of column 60*b* and/or coupling operation of column 60*h* with that of column 60*g*).

In the foregoing, zones Z1 to Z8 are defined as distinct non-overlapping zones. It might however be advantageous to define zones Z1 to Z8 as partly overlapping zones, part of the measurement samples belonging accordingly to two neighbouring zones. Overlapping of the zones might particularly be useful in case there is a substantial overlap between the radiation area of the columns of heating elements (i.e. when two neighbouring columns of heating elements both contribute to heating a common portion of the surface of the cylinder). The amount of overlap between the zones would be determined on the basis of the "heating overlap" between two neighbouring columns of heating elements.

Figure 7:
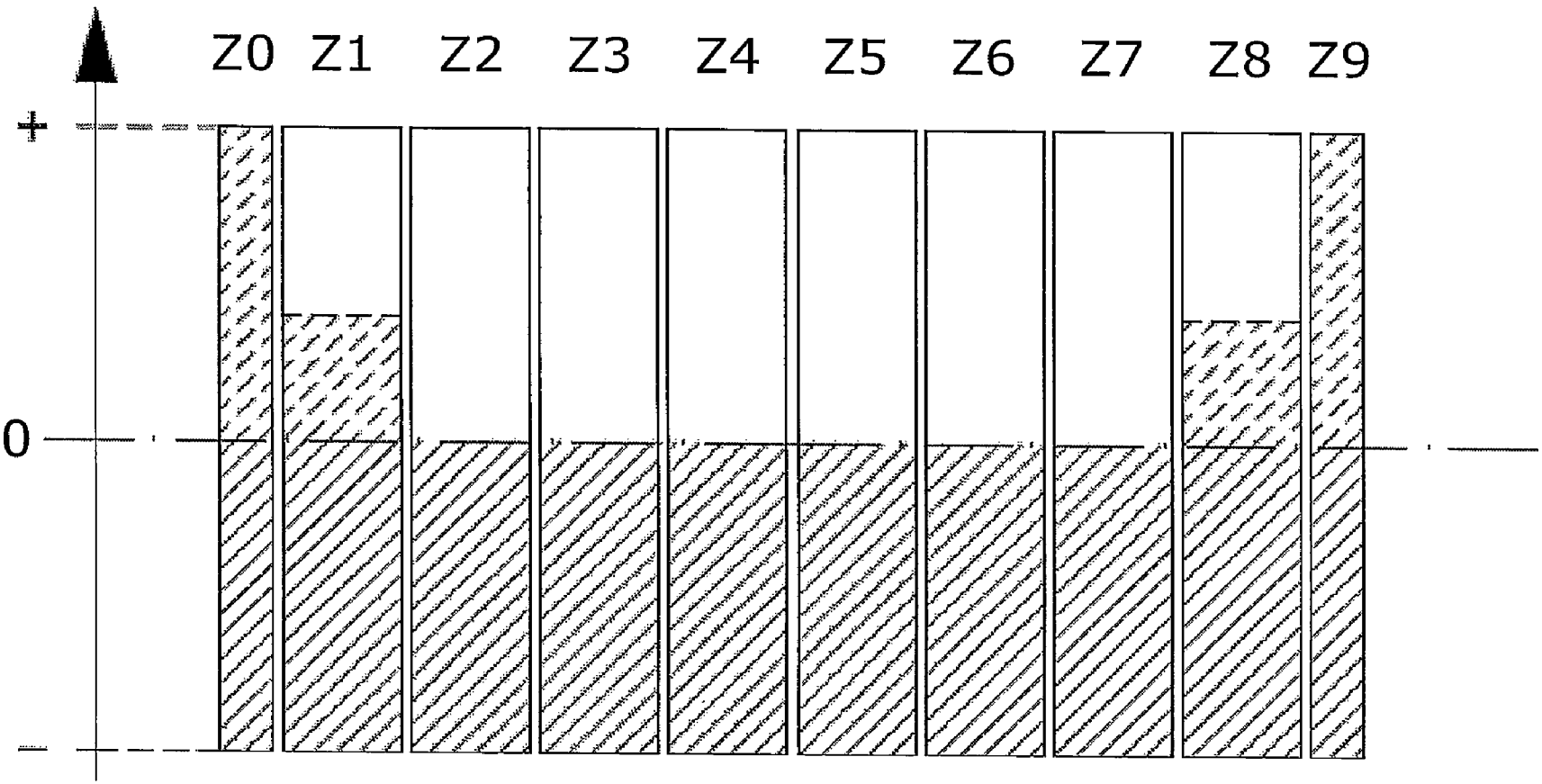
FIG. 7 is a schematic illustration of an additional capability of the system enabling the operator to manually adjust the heating profile for each heating zone.

In order to provide even greater flexibility to the operator to adjust operation of the heating elements, it might further be advantageous to be able to additionally adjust operation of the heating elements within each of the zones Z0 to Z9 in a manual manner. FIG. 7 schematically illustrates this additional adjustment capability. Each zone Z0 to Z9 is schematically depicted in FIG. 7 as a vertical bar. The horizontal zero line at mid distance illustrates a zero adjustment of the zones, i.e. a normal setting by which operation of the heating elements with the zones Z0 to Z9 follows the general settings, namely reaching and maintaining a common target surface temperature $t_C$. The upper and lower horizontal lines respectively represent the maximum temperature offset above and below the general temperature setting (for example +10° C. above $t_C$ and −10° C. below $t_C$). The dashed-hatched lines in FIG. 7, schematically illustrate a possible manual setting by which zones Z0 and Z9 (i.e. the zones encompassing the lateral heating elements 601, 602) are operated +10° C. above the desired surface temperature $t_C$ and zones Z1 and Z8 are operated approximately +4° C. above the desired surface temperature $t_C$, the other zones Z2 to Z7 remaining at their nominal adjustment setting. This enables the operator to selectively adjust the heating profile of the heating means 6 for each heating zones Z0 to Z9.

It will be understood that various modifications and/or improvements obvious to the person skilled in the art can be made to the embodiments described hereinabove without departing from the scope of the invention defined by the annexed claims. For example, rather than scanning the cylinder and its surrounding area and thereafter selecting the appropriate measurement portion from the resulting temperature measurement profile, it might be envisaged to adjust the temperature sensing system so that it scans only the effective surface of the cylinder. The scanning scheme proposed hereinabove is however preferred because it does not require specific adjustment of the temperature sensing system, all the processing being done by the central processing unit. Further, scanning the whole area provides a useful information regarding the temperature behaviour at the two ends of the cylinder. In addition, the sharp decline at the left-hand side and right-hand side in the temperature measurement profile (as illustrated in FIG. 6) provides useful confirmation of the effective dimensions of the cylinder.

In the foregoing, one will understand that the apparatus is adapted to perform coating of the cylinder C according to the following step-by-step operation scheme:

(a) the cylinder C is mounted horizontally for rotation about its axis of rotation;

(b) the cylinder C is driven into rotation (c) the surface of the cylinder C is pre-heated by means of the heating means 6 while the cylinder C is rotated;

(d) a layer of heat-hardenable plastic composition is applied onto the pre-heated surface of the cylinder C; and (e) the layer of heat-hardenable plastic composition applied onto the surface of the cylinder C is heat-cured by means of the heating means 6.

Each of step (c) and step (e) include the steps of (i) measuring the surface temperature of the cylinder C along the length of the cylinder, and (ii) controlling operation of the heating elements 60 as a function of the measured surface temperature and a desired temperature setting $t_C$. According to the invention, the measuring step (i) includes outputting the temperature measurement profile $T_M$ representative of the surface temperature of the cylinder measured along the length of the cylinder, the temperature measurement profile $T_M$ being subdivided into a plurality of zones Z1 to Z8 each associated to one corresponding column of heating elements 60*a* to 60. On the other hand, controlling step (ii) includes controlling operation of each column of heating elements 60*a* to 60*h* on the basis of the surface temperature measured within at least one of the zones Z1 to Z8.

The invention claimed is:

1. An apparatus for coating a cylinder with a plastic composition comprising:

supporting means for horizontally mounting a cylinder (C) for rotation about its axis of rotation;

a coating unit disposed on one side of the cylinder for selectively applying a layer of heat-hardenable plastic composition onto the surface of the cylinder (C) ;

driving means for rotating the cylinder (C) in a direction to cause its peripheral surface to move past said coating unit;

heating means for applying radiant heat to said cylinder (C) throughout its length as said cylinder is rotated, said heating means including a plurality of discrete heating elements distributed along the length of the cylinder and around at least part of the peripheral surface of the cylinder (C), said heating elements being arranged at least in separate columns disposed parallel to one another along the length of the cylinder ;

a temperature sensing system for measuring the surface temperature of the cylinder (C) along the whole length of the cylinder; and a processing unit coupled to the temperature sensing system for controlling operation of said heating elements as a function of the measured surface temperature and a desired temperature setting ($t_c$), wherein said temperature sensing system is adapted to output a temperature measurement profile ($T_m$) representative of the surface temperature of the cylinder measured along the whole length of the cylinder, which temperature measurement profile ($T_m$) comprises a plurality of measurement samples taken along the length of the cylinder (C), said temperature measurement profile being subdivided into a plurality of zones (Z1 to Z8) each associated to one corresponding column of heating elements, each zone (Z1 to Z8) encompassing a corresponding series of measurement samples, and wherein the processing unit is adapted to control operation of each column of heating elements on the basis of the surface temperature measured within at least one of said zones (Z1 to Z8).

2. The apparatus according to claim 1, wherein, for each zone (Z1 to Z8), said processing unit is adapted to compute a temperature measurement value based on the series of measurement samples of the zone (Z1 to Z8), said temperature measurement value being defined as the mean value or maximum value among the series of measurement samples of the zone.

3. The apparatus according to claim 1, wherein the zones (Z1 to Z8) are non-overlapping zones of said temperature measurement profile ($T_m$).

4. The apparatus according to claim 1, wherein the zones (Z1 to Z8) are overlapping zones of said temperature measurement profile ($T_m$).

5. The apparatus according to claim 1, wherein at least one column of heating elements is controlled totally or partly on the basis of the zone of a neighbouring column of heating elements.

6. The apparatus according to claim 1, further comprising lateral heating elements for applying radiant heat to each extremity of the cylinder (C).

7. The apparatus according to claim 6, wherein operation of each of said lateral heating elements is controlled on the basis of the surface temperature measured within at least one of said zones (Z1 to Z8).

8. The apparatus according to claim 1, wherein a heating power of at least the two outer-located columns of heating elements is greater than the centrally-located columns of heating elements.

9. The apparatus according to claim 1, wherein said temperature sensing system is adapted to scan an area greater than the area of the cylinder and wherein said processing unit is adapted to isolate an effective measurement portion of said temperature measurement profile ($T_m$) corresponding to the cylinder (C) to be coated based on the dimensions ($L_0$, $r_0$) and position ($d_0$) of the cylinder (C), said processing unit performing control of operation of said heating means based on said effective measurement portion of the temperature measurement profile ($T_m$).

10. The apparatus according to claim 1, wherein said temperature sensing system comprises a single contact-less sensor (90) fixedly secured to the apparatus and which is adapted to scan the whole length of the cylinder.

11. The apparatus according to claim 10, wherein said temperature sensing system is centrally located.

12. The apparatus according to claim 1, wherein said temperature sensing system comprises a line sensor extending along a parallel to the axis of rotation of the cylinder (C) and adapted to take a snap-shot of a complete line on the surface of the cylinder.

13. The apparatus according to claim 1, wherein a heating output of the heating elements is additionally manually adjustable.

14. The apparatus according to claim 1, wherein the cylinder is a wiping cylinder of an intaglio printing press.

15. A method for coating a cylinder (C) with a plastic composition comprising the following steps:

(a) mounting a cylinder (C) horizontally for rotation about its axis of rotation ;

(b) driving the cylinder (C) into rotation ;

(c) pre-heating the surface of the cylinder (C) by means of heating means while the cylinder (C) is rotated, said heating means applying radiant heat to said cylinder throughout its length and including a plurality of discrete heating elements distributed along the length of the cylinder and around at least part of the peripheral surface of the cylinder (C), the heating means being arranged at least in separate columns disposed parallel to one another along the length of the cylinder;

(d) applying a layer of heat-hardenable plastic composition onto the surface of the cylinder (C); and (e) heat-curing the layer of heat-hardenable plastic composition applied onto the surface of the cylinder (C) by means of the said heating means, said steps (c) of pre-heating and (e) of heat-curing each including the steps of:

(i) measuring the surface temperature of the cylinder (C) along the whole length of the cylinder; and (ii) controlling operation of the heating elements as a function of the measured surface temperature and a desired temperature setting ($t_c$), wherein measuring step (i) includes outputting a temperature measurement profile ($T_M$) representative of the surface temperature of the cylinder measured along the whole length of the cylinder, which temperature measurement profile ($T_m$) comprises a plurality of measurement samples taken along the length of the cylinder (C), said temperature measurement profile being subdivided into a plurality of zones (Z1 to Z8) each associated to one corresponding column of heating elements, each zone (Z1 to Z8) encompassing a corresponding series of measurement samples, and wherein controlling step (ii) includes controlling operation of each column of heating elements on the basis of the surface temperature measured within at least one of said zones (Z1 to Z8).

16. The method according to claim 15, wherein the cylinder is a wiping cylinder of an intaglio printing press.

* * * * *